US011367373B1

(12) United States Patent
Yang et al.

(10) Patent No.: US 11,367,373 B1
(45) Date of Patent: Jun. 21, 2022

(54) DRIVER INTEGRATED CIRCUIT

(71) Applicant: Novatek Microelectronics Corp., Hsinchu (TW)

(72) Inventors: Hsiu-Hui Yang, Hsinchu (TW); Yu-Shao Liu, Kaohsiung (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/168,150

(22) Filed: Feb. 4, 2021

(51) Int. Cl.
*G09G 5/00* (2006.01)
*G09G 3/20* (2006.01)

(52) U.S. Cl.
CPC ..... *G09G 3/20* (2013.01); *G09G 2300/08* (2013.01); *G09G 2320/0219* (2013.01)

(58) Field of Classification Search
CPC ..... G09G 3/20; G09G 2320/0219; G09G 2300/08; G09G 2310/0286; G09G 2310/0289; G09G 2310/0291
See application file for complete search history.

(56) References Cited

U.S. PATENT DOCUMENTS

2018/0075817 A1* 3/2018 Kim ..... G09G 3/3688
2018/0181277 A1* 6/2018 Ahn ..... G06F 3/0481

* cited by examiner

*Primary Examiner* — Adam R. Giesy
(74) *Attorney, Agent, or Firm* — JCIPRNET

(57) ABSTRACT

A driver integrated circuit, including multiple output pads, multiple switching circuits, and multiple data channel circuits, is provided. The output pads and the switching circuits are arranged in a pad area of the driver integrated circuit. The output pads include a first output pad and a second output pad, and the switching circuits include a first switching circuit. A first selection terminal of the first switching circuit is coupled to the first output pad. A second selection terminal of the first switching circuit is coupled to the second output pad. The data channel circuits are arranged in a function circuit area of the driver integrated circuit. The data channel circuits include a first data channel circuit. An output terminal of the first data channel circuit is coupled to a common terminal of the first switching circuit.

9 Claims, 3 Drawing Sheets

DRIVER INTEGRATED CIRCUIT

BACKGROUND

Technical Field

The disclosure relates to an integrated circuit (IC), and particularly relates to a layout of a driver IC.

Description of Related Art

The driver IC may drive multiple data lines of a display panel to display an image. In detail, multiple data channel circuits of the driver IC may convert multiple subpixel data (digital) into multiple data voltages (analog), and then output the data voltages to the data lines of the display panel via multiple output pads. In the driver IC, the output terminals of the data channel circuits are connected to the output pads via multiple connecting wires (conductive lines). Generally speaking, there are a large number of the connecting wires. The connecting wires are parallel to each other, and the parallel path is very long. The pitch between the connecting wires is very small, so parasitic capacitances are formed between the connecting wires. In the case where the data channel circuits continuously drive the connecting wires, the voltage coupling effect between the connecting wires is still slight.

For some practical designs, in the driver IC, multiple output pads can share a data channel circuit in time sharing. For example, the same data channel circuit may output a first data voltage to a first output pad via a first connecting wire (conductive wire) in a first period, and output a second data voltage to a second output pad via a second connecting wire in a second period. When the first connecting wire is used to transmit the first data voltage, the second connecting wire is in the electrical floating (or high impedance, Hi-Z) state. Conversely, when the second connecting wire is used to transmit the second data voltage, the first connecting wire is in the electrical floating (or high impedance) state. A connecting wire in the electrical floating (or high impedance) state is easily influenced by the voltage coupling effect of the adjacent connecting wire, which causes the voltage level of the connecting wire in the electrical floating (or high impedance) state to shift, thereby causing the brightness of display pixels to be wrong.

It should be noted that the content of the "Description of Related Art" section is used to help understand the disclosure. Part of the content (or all of the content) disclosed in the "Description of Related Art" section may not be the conventional technology known to persons skilled in the art. The content disclosed in the "Description of Related Art" section does not represent that the content is already known to persons skilled in the art before the application of the disclosure.

SUMMARY

The disclosure provides a driver integrated circuit to reduce the influence of the voltage coupling effect on a connecting wire in the electrical floating state (or high impedance state) as much as possible.

In an embodiment of the disclosure, the driver integrated circuit includes multiple output pads, multiple switching circuits, and multiple data channel circuits. The output pads are arranged in a pad area of the driver integrated circuit. The output pads include a first output pad and a second output pad. The output pads are adapted to drive multiple data lines of a display panel. The switching circuits are arranged in the pad area. These switching circuits include a first switching circuit. A first selection terminal of the first switching circuit is coupled to the first output pad. A second selection terminal of the first switching circuit is coupled to the second output pad. The data channel circuits are arranged in a function circuit area of the driver integrated circuit. The data channel circuits include a first data channel circuit. An output terminal of the first data channel circuit is coupled to a common terminal of the first switching circuit.

In an embodiment of the disclosure, the driver integrated circuit includes multiple output pads, multiple first connecting wires, multiple second connecting wires, multiple switching circuits, and multiple data channel circuits. The output pads are adapted to drive multiple data lines of a display panel. The first connecting wires are clustered in a first routing area. The second connecting wires are clustered in a second routing area. The first routing area and the second routing area do not overlap with each other. Each of the switching circuits includes a first selection terminal, a second selection terminal, and a common terminal. Each of the first selection terminals is coupled to a corresponding output pad among the output pads via a corresponding first connecting wire among the first connecting wires. Each of the second terminals is coupled to a corresponding output pad among the output pads via a corresponding second connecting wire among the second connecting wires. An output terminal of each of the data channel circuits is coupled to the common terminal of a corresponding switching circuit among the switching circuits.

Based on the foregoing, in some embodiments, the driver integrated circuit may shorten the lengths of the connecting wires between the switching circuits and the output pads as much as possible to reduce the influence of the voltage coupling effect on the connecting wire in the electrical floating state (or high impedance state). In some embodiments, the driver integrated circuit may cluster multiple connecting wires in the electrical floating state (or high impedance state) as much as possible to reduce the influence of the voltage coupling effect of the connecting wires.

In order for the features and advantages of the disclosure to be more comprehensible, specific embodiments are described in detail below in conjunction with the accompanying drawings.

DETAILED DESCRIPTION OF DISCLOSED EMBODIMENTS

Figure 1:
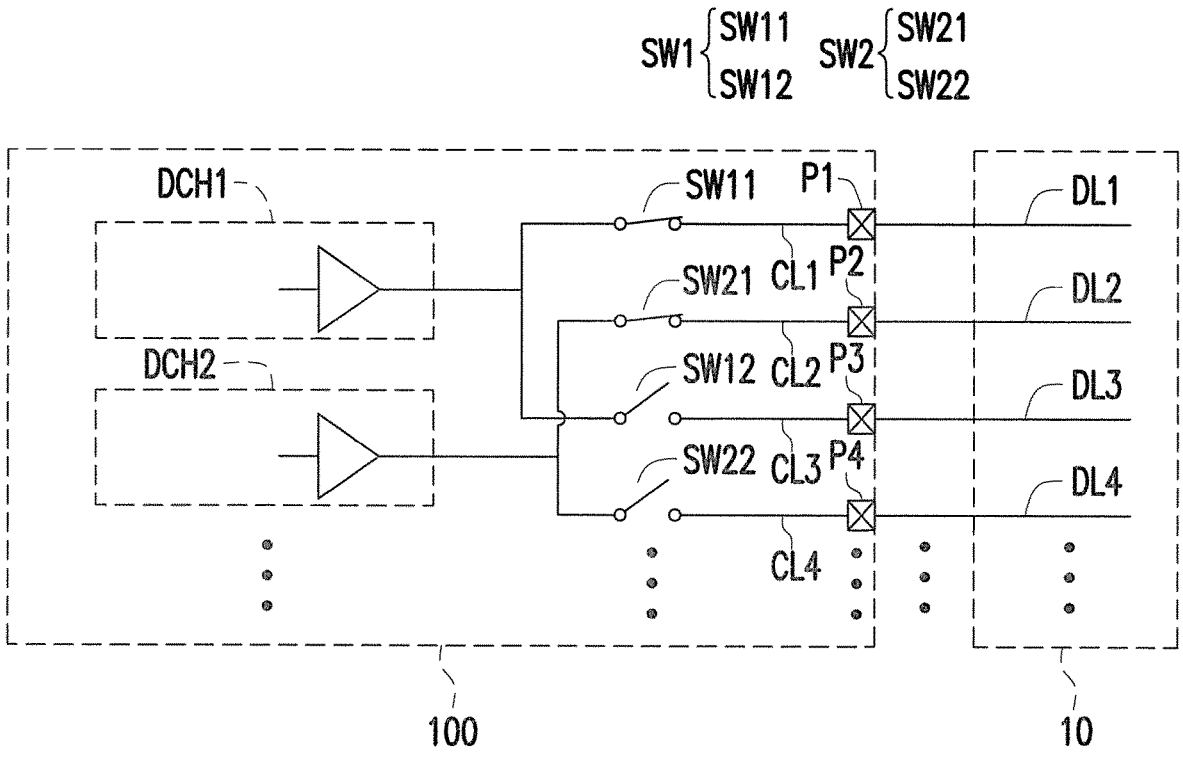
FIG. 1 is a schematic view of a circuit block of a driver integrated circuit according to an embodiment of the disclosure.

The term "coupling (or connection)" used in the entire specification (including the claims) of the present application may refer to any direct or indirect connection means. For example, if a first device is described as being coupled (or connected) to a second device, it should be interpreted that the first device may be directly connected to the second device or the first device may be indirectly connected to the second device through another device or certain connection means. Terms such as "first", "second", etc. mentioned in the entire specification (including the claims) of the present application are used to name the elements or to distinguish between different embodiments or ranges, but not to limit the upper limit or lower limit of the number of elements or to limit the sequence of the elements. In addition, wherever possible, elements/components/steps using the same reference numerals in the drawings and embodiments represent the same or similar parts. Relevant descriptions in different embodiments may be made with reference to each other for elements/components/steps using the same reference numerals or using the same terminologies.

FIG. 1 is a schematic view of a circuit block of a driver integrated circuit 100 according to an embodiment of the disclosure. The driver integrated circuit 100 shown in FIG. 1 includes multiple output pads, such as output pads P1, P2, P3, and P4 shown in FIG. 1. The output pads P1 to P4 are adapted to drive multiple data lines of a display panel 10, such as data lines DL1, DL2, DL3, and DL4 shown in FIG. 1. This embodiment does not limit the implementation details of the display panel 10. For example, the display panel 10 shown in FIG. 1 may be, but is not limited to, a conventional display panel or other display panels.

The driver integrated circuit 100 shown in FIG. 1 also includes multiple data channel circuits (such as data channel circuits DCH1 and DCH2 shown in FIG. 1) and multiple switching circuits (such as switching circuits SW1 and SW2 shown in FIG. 1). Each of the data channel circuits DCH1 and DCH2 of the driver integrated circuit 100 may convert subpixel data (digital) into a data voltage (analog), and then output the data voltage to a data line of the display panel 10 via an output pad. This embodiment does not limit the implementation details of the data channel circuits DCH1 and DCH2. For example, the data channel circuits DCH1 and DCH2 shown in FIG. 1 may, but are not limited to, include conventional data channel circuits or other data channel circuits.

An output terminal of the data channel circuit DCH1 is coupled to a common terminal of the switching circuit SW1, and an output terminal of the data channel circuit DCH2 is coupled to a common terminal of the switching circuit SW2. The switching circuit SW1 selects to couple a first selection terminal of the switching circuit SW1 to the common terminal of the switching circuit SW1 in a first period, and the switching circuit SW1 selects to couple a second selection terminal of the switching circuit SW1 to the common terminal of the switching circuit SW1 in a second period. The first selection terminal of the switching circuit SW1 is coupled to the output pad P1, and the second selection terminal of the switching circuit SW1 is coupled to the output pad P3. The switching circuit SW2 selects to couple a first selection terminal of the switching circuit SW2 to the common terminal of the switching circuit SW2 in the first period, and the switching circuit SW2 selects to couple a second selection terminal of the switching circuit SW2 to the common terminal of the switching circuit SW2 in the second period. The first selection terminal of the switching circuit SW2 is coupled to the output pad P2, and the second selection terminal of the switching circuit SW2 is coupled to the output pad P4. This embodiment does not limit the implementation details of the switching circuits SW1 and SW2.

For example, the switching circuit SW1 or SW2 shown in FIG. 1 may, but is not limited to, include a demultiplexer or other routing circuits/elements.

In the embodiment shown in FIG. 1, the switching circuit SW1 includes a switch SW11 and a switch SW12, and the switching circuit SW2 includes a switch SW21 and a switch SW22. A first terminal of the switch SW11 is coupled to the first selection terminal of the switching circuit SW1, that is, to the output pad P1. A second terminal of the switch SW11 is coupled to the common terminal of the switching circuit SW1, that is, to the output terminal of the data channel circuit DCH1. A first terminal of the switch SW21 is coupled to the first selection terminal of the switching circuit SW2, that is, to the output pad P2. A second terminal of the switch SW21 is coupled to the common terminal of the switching circuit SW2, that is, to the output terminal of the data channel circuit DCH2. A first terminal of the switch SW12 is coupled to the second selection terminal of the switching circuit SW1, that is, to the output pad P3. A second terminal of the switch SW12 is coupled to the common terminal of the switching circuit SW1, that is, to the output terminal of the data channel circuit DCH1. A first terminal of the switch SW22 is coupled to the second selection terminal of the switching circuit SW2, that is, to the output pad P4. A second terminal of the switch SW22 is coupled to the common terminal of the switching circuit SW2, that is, to the output terminal of the data channel circuit DCH2.

In the embodiment shown in FIG. 1, multiple output pads can share the same data channel circuit in time sharing. For example, the data channel circuit DCH1 may output a first data voltage to the output pad P1 via a connecting wire (conductive line) CL1 in the first period, and output a second data voltage to the output pad P3 via a connecting wire CL3 in the second period. By analogy, the data channel circuit DCH2 may output a third data voltage to the output pad P2 via a connecting wire CL2 in the first period, and output a fourth data voltage to the output pad P4 via a connecting wire CL4 in the second period.

Figure 2:
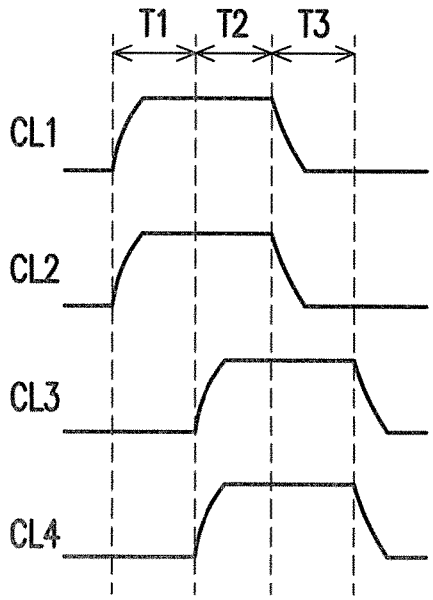
FIG. 2 is a schematic view illustrating ideal waveforms of voltages of connecting wires shown in FIG. 1 according to an embodiment of the disclosure.

FIG. 2 is a schematic view illustrating ideal waveforms of voltages of connecting wires CL1 to CL4 shown in FIG. 1 according to an embodiment of the disclosure. Please refer to FIG. 1 and FIG. 2. In a period T1, the switches SW11 and SW21 are turned on, so the data channel circuit DCH1 may output the first data voltage to the output pad P1 via the connecting wire CL1, and the data channel circuit DCH2 may output the third data voltage to the output pad P2 via the connecting wire CL2. In the period T1, the switches SW12 and SW22 are turned off, so the states of the connecting wires CL3 and CL4 may be referred to as the electrical floating state or the high impedance (Hi-Z) state. As shown by the ideal waveforms in FIG. 2, the voltages of the connecting wires CL3 and CL4 in the electrical floating state (or high impedance state) are expected to be maintained at a voltage level before the period T1. The relevant operation of a period T3 shown in FIG. 2 may be deduced by analogy with reference to the relevant description of the period T1, so there will be no reiteration.

In a period T2 after the period T1, the switches SW12 and SW22 are turned on, so the data channel circuit DCH1 may output the second data voltage to the output pad P3 via the connecting wire CL3, and the data channel circuit DCH2 may output the fourth data voltage to the output pad P4 via the connecting wire CL4. In the period T2, the switches SW11 and SW21 are turned off, so the states of the connecting wires CL1 and CL2 may be referred to as the electrical floating state or the high impedance state. As shown by the ideal waveforms in FIG. 2, the voltages of the connecting wires CL1 and CL2 in the electrical floating state (or high impedance state) are expected to be maintained at a voltage level before the period T2.

However, a connecting wire in the electrical floating state (or high impedance state) is easily influenced by the voltage coupling effect of the adjacent connecting wire, which causes the voltage level of the connecting wire in the electrical floating state (or high impedance state) to shift. The greater the parasitic capacitance between two adjacent connecting wires, the stronger the influence of the voltage coupling effect. The smaller the distance between two adjacent connecting wires, the greater the parasitic capacitance. The longer the path length of the parallel part of two adjacent connecting wires, the greater the parasitic capacitance.

Figure 3:
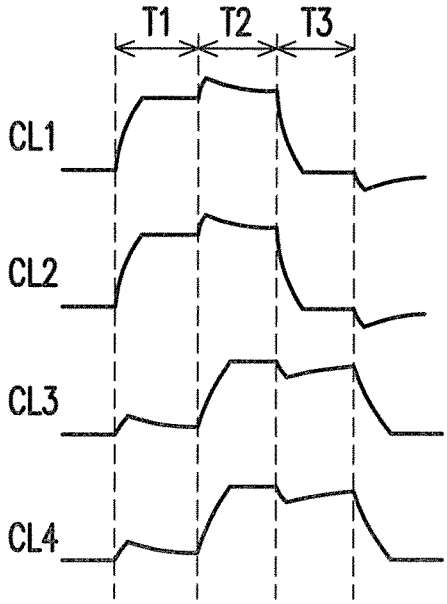
FIG. 3 is a schematic view illustrating actual waveforms of the voltages of the connecting wires shown in FIG. 1 according to an embodiment of the disclosure.

FIG. 3 is a schematic view illustrating actual waveforms of the voltages of the connecting wires CL1 to CL4 shown in FIG. 1 according to an embodiment of the disclosure. For the relevant operation of the periods T1, T2, and T3 shown in FIG. 3, reference may be made to the relevant description of the periods T1, T2, and T3 shown in FIG. 2, so there will be no reiteration. Please refer to FIG. 1 and FIG. 3. There are parasitic capacitances between the connecting wires CL1 to CL4. Due to the voltage coupling effect, the voltage transitions of the connecting wires CL1 and CL2 in the period T1 will be coupled to the connecting wires CL3 and CL4 in the electrical floating state (or high impedance state), which causes the voltage levels of the connecting wires CL3 and CL4 to shift. By analogy, the voltage transitions of the connecting wires CL3 and CL4 in the period T2 will be coupled to the connecting wires CL1 and CL2 in the electrical floating state (or high impedance state), which causes the voltage levels of the connecting wires CL1 and CL2 to shift. When the amount of shift of the voltage level of the connecting wire is too large, the brightness of display pixels are wrong.

Due to the influence of the voltage coupling effect, the voltage level of the connecting wire in the electrical floating state (or high impedance state) is prone to shift. In the following embodiments, the lengths of the connecting wires (such as the connecting wires CL1 to CL4) between the switching circuits and the output pads are shortened as much as possible. The shorter the length of the connecting wire in the electrical floating state (or high impedance state), the weaker the influence of the voltage coupling effect. The driver integrated circuit 100 may shorten the lengths of the connecting wires CL1 to CL4 as much as possible to reduce the voltage coupling effect on the connecting wire in the electrical floating state (or high impedance state) as much as possible. In some other embodiments as follows, the lengths of multiple connecting wires in the electrical floating state (or high impedance state) are clustered as much as possible to reduce the voltage coupling effect of the connecting wires as much as possible.

Figure 4:
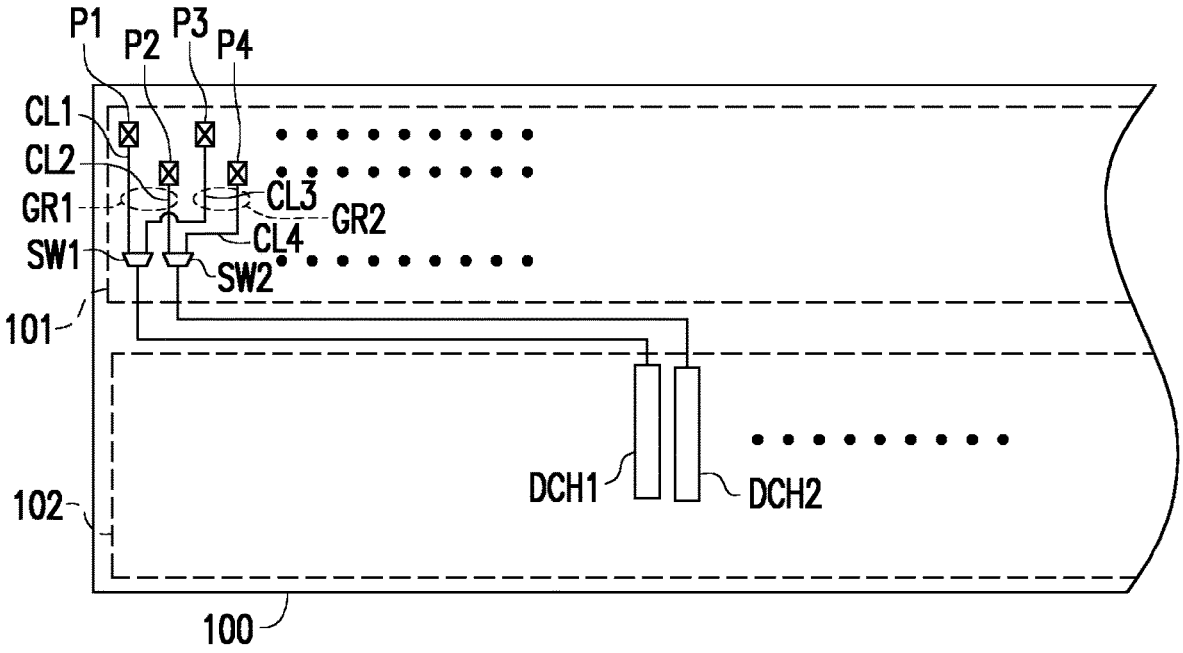
FIG. 4 is a schematic view illustrating a layout of the driver integrated circuit shown in FIG. 1 according to an embodiment of the disclosure.

FIG. 4 is a schematic view illustrating a layout of the driver integrated circuit 100 shown in FIG. 1 according to an embodiment of the disclosure. For the embodiment shown in FIG. 4, reference may be made to the relevant description of FIG. 1. The driver integrated circuit 100 shown in FIG. 4 includes a pad area 101 and a function circuit area 102. In the embodiment shown in FIG. 4, the output pads P1 to P4 and the switching circuits SW1 and SW2 are arranged in the pad area 101 of the driver integrated circuit 100, and the data channel circuits DCH1 and DCH2 are arranged in the function circuit area 102 of the driver integrated circuit 100.

The shorter the length of the connecting wire in the electrical floating state (or high impedance state), the weaker the influence of the voltage coupling effect. The switching circuit SW1 is close to the output pad P1 and the output pad P3 to shorten the connecting wire CL1 between the switching circuit SW1 and the output pad P1 as much as possible, and shorten the connecting wire CL3 between the switching circuit SW1 and the output pad P3 as much as possible. Similarly, the switching circuit SW2 is close to the output pad P2 and the output pad P4 to shorten the connecting wire CL2 between the switching circuit SW2 and the output pad P2 as much as possible, and shorten the connecting wire CL4 between the switching circuit SW2 and the output pad P4 as much as possible. The driver integrated circuit 100 may shorten the lengths of the connecting wires CL1 to CL4 as much as possible to reduce the influence of the voltage coupling effect on the connecting wire in the electrical floating state (or high impedance state) as much as possible.

The first selection terminal of the switching circuit SW1 is coupled to the output pad P1 via the connecting wire CL1, and the second selection terminal of the switching circuit SW1 is coupled to the output pad P3 via the connecting wire CL3. The first selection terminal of the switching circuit SW2 is coupled to the output pad P2 via the connecting wire CL2, and the second selection terminal of the switching circuit SW2 is coupled to the output pad P4 via the connecting wire CL4. In the first period, the switching circuit SW1 selects to couple the first selection terminal of the switching circuit SW1 to the common terminal of the switching circuit SW1, and the switching circuit SW2 selects to couple the first selection terminal of the switching circuit SW2 to the common terminal of the switching circuit SW2, so the connecting wire CL1 and the connecting wire CL2 connected to the first selection terminals of the switching circuits SW1 and SW2 are referred to as first connecting wires here. In the second period, the switching circuit SW1 selects to couple the second selection terminal of the switching circuit SW1 to the common terminal of the switching circuit SW1, and the switching circuit SW2 selects to couple the second selection terminal of the switching circuit SW2 to the common terminal of the switching circuit SW2, so the connecting wire CL3 and the connecting wire CL4 connected to the second selection terminals of the switching circuits SW1 and SW2 are referred to as second connecting wires here.

In the embodiment shown in FIG. 4, the pad area 101 includes a routing area GR1 and a routing area GR2 that do not overlap with each other. The first connecting wires (the connecting wires CL1 and CL2) are clustered in the routing area GR1, and the second connecting wires (the connecting wires CL3 and CL4) are clustered in the routing area GR2. In the embodiment shown in FIG. 4, the lengths of multiple connecting wires in the electrical floating state (or high impedance state) may be clustered as much as possible to reduce the influence of the voltage coupling effect of the connecting wires as much as possible.

Figure 5:
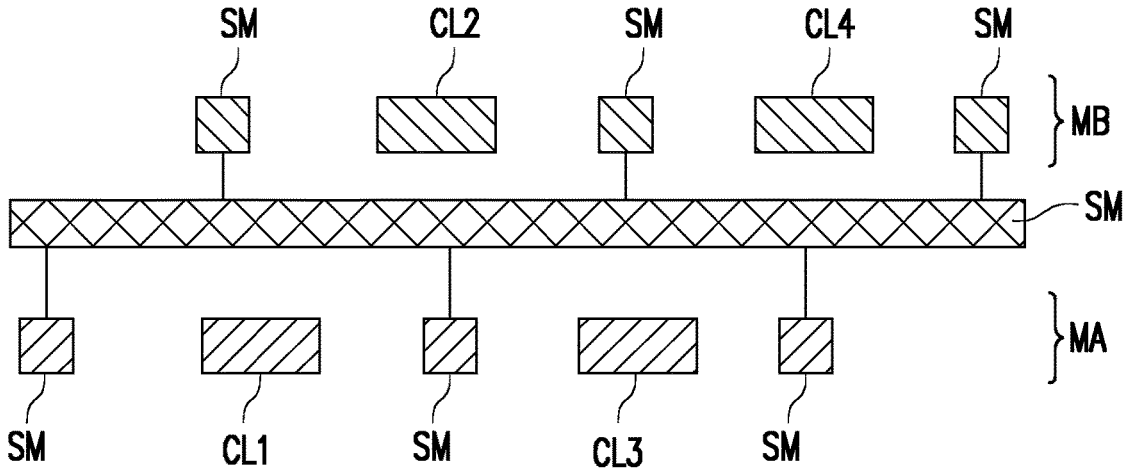
FIG. 5 is a schematic cross-sectional view illustrating connecting wires shown in FIG. 4 according to an embodiment of the disclosure.

FIG. 5 is a schematic cross-sectional view illustrating the connecting wires CL1 to CL4 shown in FIG. 4 according to an embodiment of the disclosure. Please refer to FIG. 4 and FIG. 5. A first terminal and a second terminal of the connecting wire CL1 are respectively coupled to the first selection terminal of the switching circuit SW1 and the output pad P1. A first terminal and a second terminal of the connecting wire CL3 are respectively coupled to the second selection terminal of the switching circuit SW1 and the output pad P3. In the embodiment shown in FIG. 5, the connecting wire CL1 and the connecting wire CL3 may be arranged in a conductive layer MA, and an electrical shielding structure SM may be arranged between the connecting wire CL1 and the connecting wire CL3. According to the actual design, the electrical shielding structure SM includes a shielding metal.

A first terminal and a second terminal of the connecting wire CL2 are respectively coupled to the first selection terminal of the switching circuit SW2 and the output pad P2. A first terminal and a second terminal of the connecting wire CL4 are respectively coupled to the second selection terminal of the switching circuit SW2 and the output pad P4. In the embodiment shown in FIG. 5, the connecting wire CL2 and the connecting wire CL4 may be arranged in a conductive layer MB, and the electrical shielding structure SM may be arranged between the connecting wire CL2 and the connecting wire CL4. In addition, according to the actual design, the electrical shielding structure SM may be arranged between the conductive layer MB and the conductive layer MA. In other embodiments, according to the actual design, the electrical shielding structure SM may be omitted.

Figure 6:
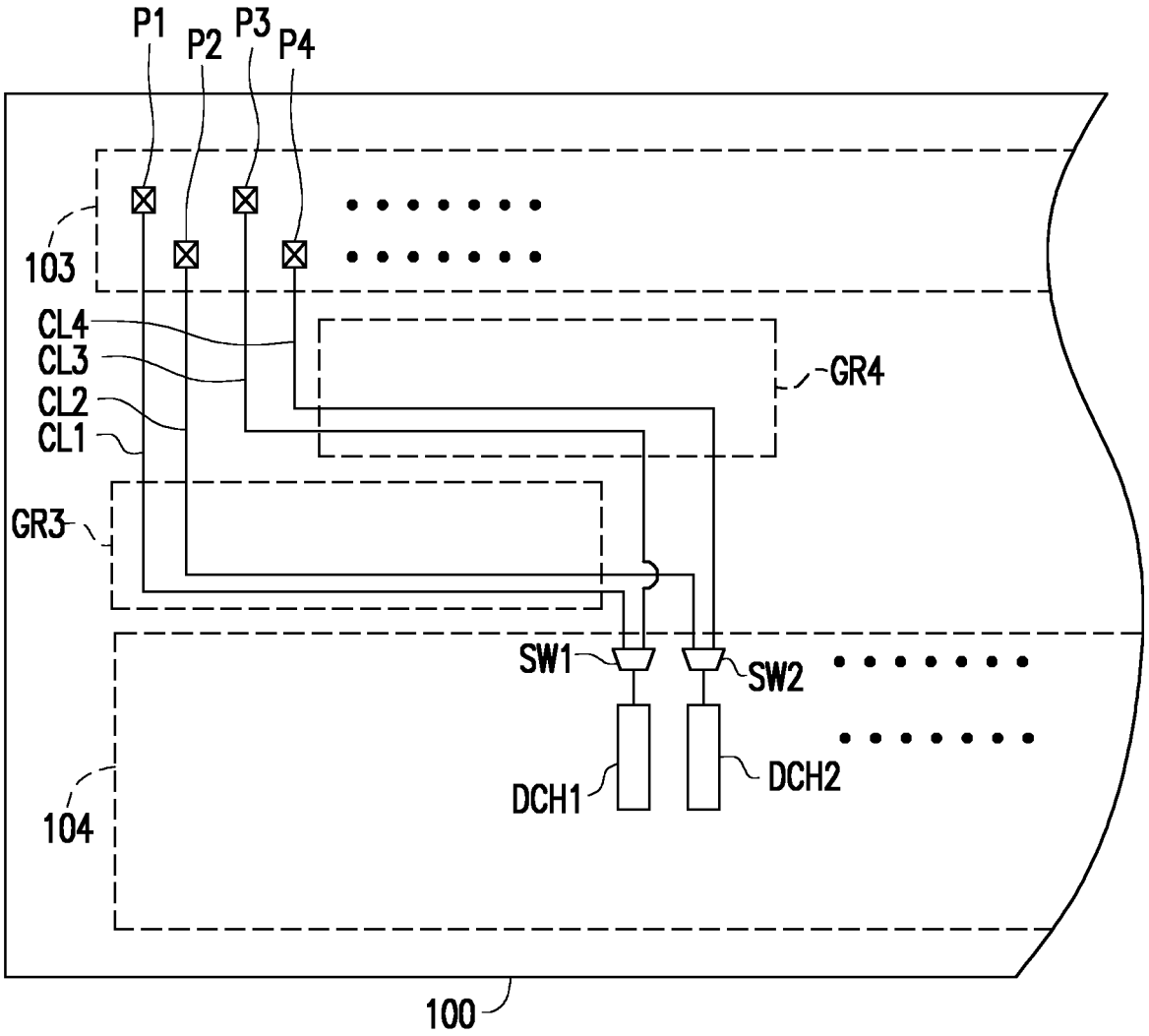
FIG. 6 is a schematic view illustrating the layout of the driver integrated circuit shown in FIG. 1 according to another embodiment of the disclosure.

FIG. 6 is a schematic view illustrating the layout of the driver integrated circuit 100 shown in FIG. 1 according to another embodiment of the disclosure. For the embodiment shown in FIG. 6, reference may be made to the relevant description of FIG. 1. The driver integrated circuit 100 shown in FIG. 6 includes a pad area 103 and a function circuit area 104. In the embodiment shown in FIG. 6, the output pads P1 to P4 are arranged in the pad area 103 of the driver integrated circuit 100, and the data channel circuits DCH1 and DCH2 and the switching circuits SW1 and SW2 are arranged in the function circuit area 104 of the driver integrated circuit 100.

The first selection terminal of the switching circuit SW1 is coupled to the output pad P1 via the connecting wire CL1, and the first selection terminal of the switching circuit SW2 is coupled to the output pad P2 via the connecting wire CL2. In the first period, the switching circuit SW1 selects to couple the first selection terminal of the switching circuit SW1 to the common terminal of the switching circuit SW1, and the switching circuit SW2 selects to couple the first selection terminal of the switching circuit SW2 to the common terminal of the switching circuit SW2, so the connecting wire CL1 and the connecting wire CL2 connected to the first selection terminals of the switching circuits SW1 and SW2 are referred to as the first connecting wires here. The second selection terminal of the switching circuit SW1 is coupled to the output pad P3 via the connecting wire CL3, and the second selection terminal of the switching circuit SW2 is coupled to the output pad P4 via the connecting wire CL4. In the second period, the switching circuit SW1 selects to couple the second selection terminal of the switching circuit SW1 to the common terminal of the switching circuit SW1, and the switching circuit SW2 selects to couple the second selection terminal of the switching circuit SW2 to the common terminal of the switching circuit SW2, so the connecting wire CL3 and the connecting wire CL4 connected to the second selection terminals of the switching circuits SW1 and SW2 are referred to as the second connecting wires here.

In the embodiment shown in FIG. 6, the driver integrated circuit 100 further includes a routing area GR3 and a routing area GR4 that do not overlap with each other. The first connecting wires (the connecting wires CL1 and CL2) are clustered in the routing area GR3, and the second connecting wires (the connecting wires CL3 and CL4) are clustered in the routing area GR4. The embodiment shown in FIG. 6 may cluster the lengths of multiple connecting wires in the electrical floating state (or high impedance state) as much as possible to reduce the influence of the voltage coupling effect of the connecting wires as much as possible.

According to the actual design, the electrical shielding structure SM shown in FIG. 5 may also be applied between the connecting wires CL1 to CL4 shown in FIG. 6. In other embodiments, the electrical shielding structure SM may be omitted.

In summary, in some embodiments, the driver integrated circuit 100 may reduce the lengths of the connecting wires between the switching circuits and the output pads as much as possible to reduce the influence of the voltage coupling effect on the connecting wire in the electrical floating state (or high impedance state) as much as possible. In some embodiments, the driver integrated circuit 100 may cluster multiple connecting wires in the electrical floating state (or high impedance state) as much as possible to reduce the influence of the voltage coupling effect of the connecting wires as much as possible.

Although the disclosure has been disclosed in the above embodiments, the above embodiments are not intended to limit the disclosure. Persons skilled in the art may make some changes and modifications without departing from the spirit and scope of the disclosure. Therefore, the protection scope of the disclosure shall be defined by the scope of the appended claims.

What is claimed is:

1. A driver integrated circuit, comprising:

a plurality of output pads, arranged in a pad area of the driver integrated circuit and adapted to drive a plurality of data lines of a display panel, wherein the plurality of output pads comprise a first output pad and a second output pad;

a plurality of switching circuits, arranged in the pad area, wherein the plurality of switching circuits comprise a first switching circuit, a first selection terminal of the first switching circuit is coupled to the first output pad, and a second selection terminal of the first switching circuit is coupled to the second output pad;

a plurality of data channel circuits, arranged in a function circuit area of the driver integrated circuit, wherein the plurality of data channel circuits comprise a first data channel circuit, and an output terminal of the first data channel circuit is coupled to a common terminal of the first switching circuit;

a first connecting wire, having a first terminal and a second terminal respectively coupled to the first selection terminal of the first switching circuit and the first output pad;

a second connecting wire, having a first terminal and a second terminal respectively coupled to the second selection terminal of the first switching circuit and the second output pad; and an electrical shielding structure, arranged between the first connecting wire and the second connecting wire.

2. The driver integrated circuit according to claim 1, wherein the first switching circuit is close to the first output pad and the second output pad to shorten a connecting wire between the first switching circuit and the first output pad, and a connecting wire between the first switching circuit and the second output pad.

3. The driver integrated circuit according to claim 1, wherein the first switching circuit selects to couple the first selection terminal to the common terminal in a first period, and the first switching circuit selects to couple the second selection terminal to the common terminal in a second period.

4. The driver integrated circuit according to claim 1, wherein the first switching circuit comprises:

a first switch, having a first terminal coupled to the first selection terminal of the first switching circuit, wherein a second terminal of the first switch is coupled to the common terminal of the first switching circuit; and a second switch, having a first terminal coupled to the second selection terminal of the first switching circuit, wherein a second terminal of the second switch is coupled to the common terminal of the first switching circuit.

5. The driver integrated circuit according to claim 1, wherein the first selection terminal of each of the plurality of switching circuits is coupled a corresponding output pad among the plurality of output pads via a corresponding first connecting wire among a plurality of first connecting wires, the second selection terminal of each of the plurality of switching circuits is coupled to a corresponding output pad among the plurality of output pads via a corresponding second connecting wire among a plurality of second connecting wires, the pad area comprises a first routing area and a second routing area that do not overlap with each other, the plurality of first connecting wires are clustered in the first routing area, and the plurality of second connecting wires are clustered in the second routing area.

6. A driver integrated circuit, comprising:

a plurality of output pads, adapted to drive a plurality of data lines of a display panel;

a plurality of first connecting wires, clustered in a first routing area;

a plurality of second connecting wires, clustered in a second routing area, wherein the first routing area and the second routing area do not overlap with each other;

a plurality of switching circuits, wherein each of the plurality of switching circuits comprises a first selection terminal, a second selection terminal, and a common terminal, each of the plurality of first selection terminals is coupled to a corresponding output pad among the plurality of output pads via a corresponding first connecting wire among the plurality of first connecting wires, and each of the plurality of second selection terminals is coupled to a corresponding output pad among the plurality of output pads via a corresponding second connecting wire among the plurality of second connecting wires;

a plurality of data channel circuits, wherein an output terminal of each of the plurality of data channel circuits is coupled to the common terminal of a corresponding switching circuit among the plurality of switching circuits; and a plurality of electrical shielding structures, arranged between the plurality of first connecting wires and the plurality of second connecting wires.

7. The driver integrated circuit according to claim 6, wherein the plurality of output pads are arranged in a pad area of the driver integrated circuit, and the plurality of switching circuits and the plurality of data channel circuits are arranged in a function circuit area of the driver integrated circuit.

8. The driver integrated circuit according to claim 6, wherein each of the plurality of switching circuits selects to couple the first selection terminal to the common terminal in a first period, and each of the plurality of switching circuits selects to couple the second selection terminal to the common terminal in a second period.

9. The driver integrated circuit according to claim 6, wherein any one of the plurality of switching circuits comprises:

a first switch, having a first terminal coupled to the first selection terminal of the any one of the plurality of switching circuits, wherein a second terminal of the first switch is coupled to the common terminal of the any one of the plurality of switching circuits; and a second switch, having a first terminal coupled to the second selection terminal of the any one of the plurality of switching circuits, wherein a second terminal of the second switch is coupled to the common terminal of the any one of the plurality of switching circuits.

* * * * *